US007903128B2

(12) United States Patent
Ko et al.

(10) Patent No.: US 7,903,128 B2
(45) Date of Patent: Mar. 8, 2011

(54) METHOD FOR GENERATING A GAMMA TABLE

(75) Inventors: Ming-Chun Ko, Fonghua Village (TW); Shang-Chieh Wen, Fonghua Village (TW); Chien-Hsin Li, Fonghua Village (TW)

(73) Assignee: Himax Technologies Limited, Tainan County (TW)

( * ) Notice: Subject to any disclaimer, the term of this patent is extended or adjusted under 35 U.S.C. 154(b) by 817 days.

(21) Appl. No.: 11/822,771

(22) Filed: Jul. 10, 2007

(65) Prior Publication Data

US 2008/0007575 A1 Jan. 10, 2008

(30) Foreign Application Priority Data

Jul. 10, 2006 (TW) ..... 95125141 A

(51) Int. Cl.
*G09G 5/10* (2006.01)

(52) U.S. Cl. ..... 345/690; 345/89

(58) Field of Classification Search ..... 345/102, 345/690, 87, 89; 315/169.1, 169.4; 358/519, 358/521

See application file for complete search history.

(56) References Cited

U.S. PATENT DOCUMENTS

| | | | | |
|---|---|---|---|---|
| 6,909,435 | B2 | 6/2005 | Willis | |
| 6,987,499 | B2 | 1/2006 | Yamaguchi et al. | |
| 7,038,735 | B2 | 5/2006 | Coleman et al. | |
| 7,061,504 | B1 | 6/2006 | Glen | |
| 7,414,598 | B2 * | 8/2008 | Lee | 345/63 |
| 2004/0075674 | A1 * | 4/2004 | Bu | 345/690 |
| 2004/0189679 | A1 | 9/2004 | Ito et al. | |
| 2007/0052643 | A1 * | 3/2007 | Li et al. | 345/89 |

FOREIGN PATENT DOCUMENTS

| | | |
|---|---|---|
| TW | 588316 | 5/2004 |
| TW | 1236297 | 7/2005 |
| TW | 1236656 | 7/2005 |

* cited by examiner

*Primary Examiner* — Chanh Nguyen
*Assistant Examiner* — Pegeman Karimi
(74) *Attorney, Agent, or Firm* — Bacon & Thomas, PLLC

(57) ABSTRACT

A method for generating a gamma table is provided. The method is applied to a display, and the display obtains n-bit corrected gray levels [y(1), . . . , y($2^m$)] from m-bit original gray levels [x(1), . . . , x($2^m$)] by using the gamma table, wherein m and n are positive integers. The method comprises calculating the corrected gray levels [y(1), . . . , y($2^m$)] corresponding to the original gray levels [x(1) , . . . , x($2^m$)] according to a gamma curve; and successively calculating differences of two adjacent corrected gray levels (y(i+1)−y(i)) and recording the differences as a plurality of gamma reference values z(i+1) (i=1~(2m−1)) corresponding to the original gray levels x(i+1), in which the value z(1) corresponding to x(1) is y(1), in order to generate the gamma table.

4 Claims, 3 Drawing Sheets

METHOD FOR GENERATING A GAMMA TABLE

This application claims the benefit of Taiwan application Serial No. 95125141, filed Jul. 10, 2006, the subject matter of which is incorporated herein by reference.

BACKGROUND OF THE INVENTION

1. Field of the Invention

The invention relates in general to a method for generating a gamma table, and more particularly to a method for generating a gamma table by calculating and recording gamma reference values with a lower bit number from the known corrected gray levels.

2. Description of the Related Art

The liquid crystal display (LCD), due to advantages of small volume, low weight and low electromagnetic radiation, has been widely used in these few years. However, owing that the voltage drop across two sides of liquid crystal molecules is not linearly proportional to the light transmittance, when the digital image data to be displayed is converted into the voltage signals to the two sides of the liquid crystal molecules, a gamma correction operation has to be performed in order to reduce color distortion of the LCD.

Normally, the gamma correction operation is performed to generate corrected gray levels from the original gray levels of pixels via mapping according to a gamma curve. The gamma curve is a gamma table recorded in a relevant circuit of the display. When the LCD has to perform the gamma correction operation, the required corrected gray levels corresponding to the original gray levels can be obtained according to the recorded gamma table.

In the gamma correction of the LCD, for example, 10 bits of corrected gray levels y are generated from 8 bits of original gray levels x, wherein x=0~255, y=0~1023, $y=(x/255)^{\gamma}\times 1023$, and y is a gamma coefficient. Supposed that compression or correction is not performed, the memory space required by the LCD is 256×10=2560 bits. Owing to the large memory space, the LCD has a lower speed of gamma correction and a higher manufacturing cost.

SUMMARY OF THE INVENTION

The invention is directed to a method for generating a gamma table. In the method, gamma reference values with a lower bit number are calculated from the corrected gray levels and recorded to generate the gamma table. When gamma correction is required, the desired corrected gray levels are restored from the gamma reference values of the gamma table in order to achieve the purpose of saving memory space.

According to a first aspect of the present invention, a method for generating a gamma table is provided. The method is applied to a display, and the display obtains n-bit corrected gray levels $[y(1), \ldots, y(2^m)]$ from m-bit original gray levels $[x(1), \ldots, x(2^m)]$ by using the gamma table, wherein m and n are positive integers. The method comprises calculating the corrected gray levels $[y(1), \ldots, y(2^m)]$ corresponding to the original gray levels $[x(1), \ldots, x(2^m)]$ according to a gamma curve; and successively calculating differences of two adjacent corrected gray levels $(y(i+1)-y(i))$ and recording the differences as a plurality of gamma reference values $z(i+1)$ $(i=1\sim(2m-1))$ corresponding to the original gray levels $x(i+1)$, in which the value $z(1)$ corresponding to $x(1)$ is $y(1)$, in order to generate the gamma table.

According to a second aspect of the present invention, a method for generating a gamma table is provided. The method is applied to a display, and the display obtains n-bit corrected gray levels $[y_2(1), \ldots, y_2(2^m)]$ from m-bit original gray levels $[x(1), \ldots, x(2^m)]$ by using the gamma table, wherein m and n are positive integers. The method comprises calculating a plurality of correction reference values $[y_1(1), \ldots, y_1(2^m)]$ corresponding to the original gray levels $[x(1), \ldots, x(2^m)]$ according to a first gamma curve; calculating the corrected gray levels $[y_2(1), \ldots, y_2(2^m)]$ corresponding to the original gray levels $[x(1), \ldots, x(2^m)]$ according to a second gamma curve; and respectively calculating differences $\{(y_1(i)-y_2(i)), i=1\sim(2^m-1)\}$ or $\{(y_2(i)-y_1(i)), i=1\sim(2^m-1)\}$ of the correction reference values $[y_1(1), \ldots, y_1(2^m)]$ and the corresponding corrected gray levels $[y_2(1), \ldots, y_2(2^m)]$ and recording the differences as a plurality of gamma reference values $z(i)(i=1\sim(2^m-1))$ corresponding to the original gray levels $x(i)$ in order to generate the gamma table.

According to a third aspect of the present invention, a method for generating a gamma table is provided. The method is applied to a display, and the display obtains n-bit corrected gray levels $[y(1), \ldots, y(2^m)]$ from m-bit original gray levels $[x(1), \ldots, x(2^m)]$ by using the gamma table, wherein m and n are positive integers. The method comprises calculating a plurality of corrected gray levels $[y(1), \ldots, y(2^m)]$ corresponding to the original gray levels $[x(1), \ldots, x(2^m)]$ according to a gamma curve; calculating gray-level differences $w(i)=\{(y(i+1)-y(i)), i=1, 3, \ldots\}$ or $\{(y(i)-y(i+1)), i=1, 3, \ldots\}$ of two adjacent corrected gray levels $y(i)$ and $y(i+1)$ $(i=1, 3, \ldots)$; and respectively recording the n-bit corrected gray levels $y(i)$ and the k-bit gray-level differences $w(i)$ $(i=1, 3, \ldots)$ as (n+k)-bit gamma reference values $z(i)$ $(i=1, 3, \ldots)$ corresponding to the odd-order original gray levels $x(i)$ $(i=1, 3, \ldots)$ in order to generate the gamma table, wherein k is a positive integer.

The invention will become apparent from the following detailed description of the preferred but non-limiting embodiments. The following description is made with reference to the accompanying drawings.

DETAILED DESCRIPTION OF THE INVENTION

The invention provides a method for generating a gamma table. The feature of the invention lies in gamma reference values with a lower bit number are calculated from the corrected gray levels and recorded to generate the gamma table, and when gamma correction is required, the desired corrected gray levels are restored from the gamma reference values of the gamma table. Therefore, the memory space for storing the gamma table can be reduced to greatly lower down manufacturing cost of the display.

Embodiment One

Figure 1:
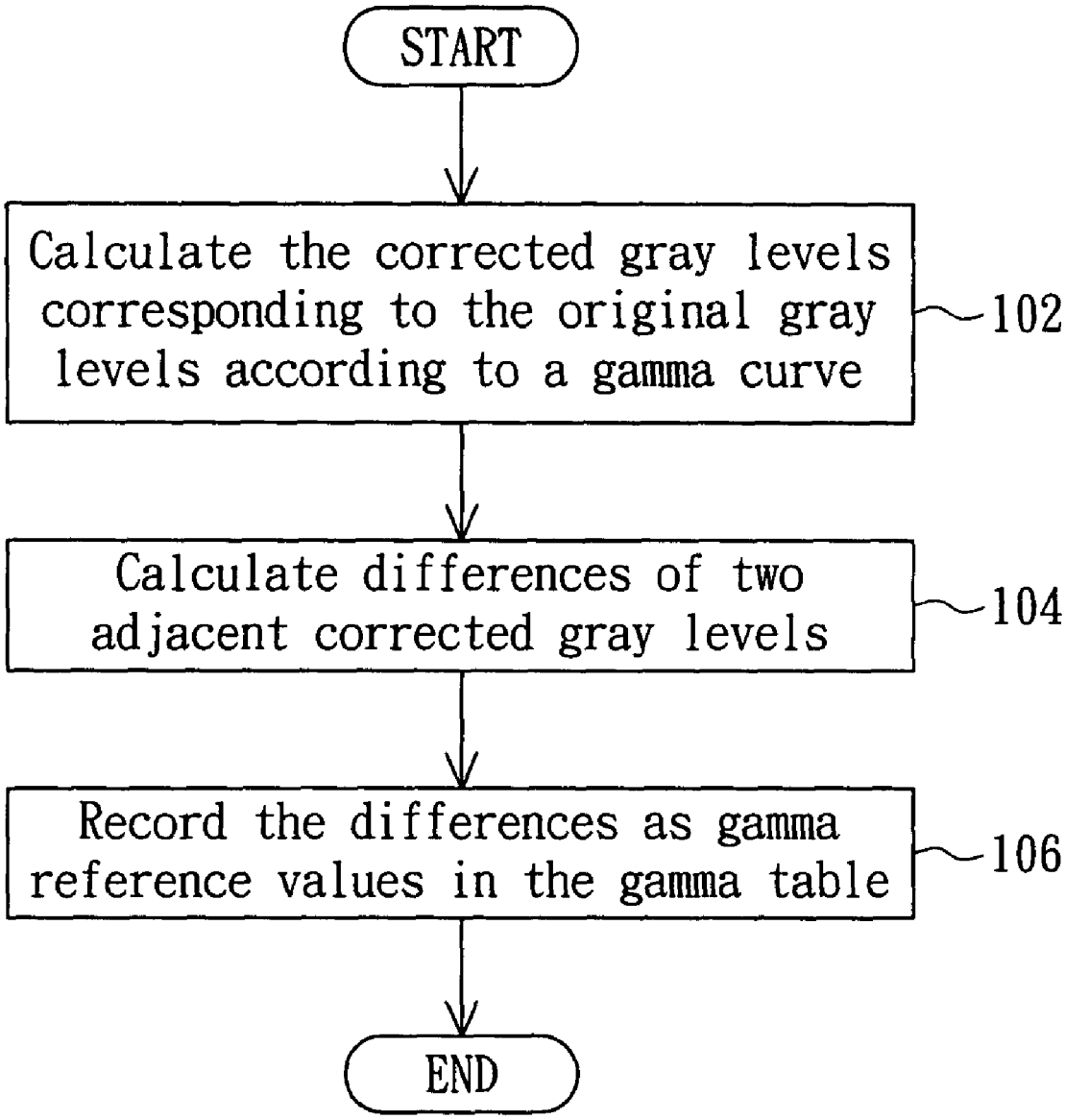
FIG. 1 is a flow chart of a method for generating a gamma table according to a first embodiment of the invention.

Referring to FIG. 1, a flow chart of a method for generating a gamma table according to a first embodiment of the invention is shown. The method for generating a gamma table is applied to a display. A number of m-bit original gray levels $[x(1), \ldots, x(2^m)]$, such as $[0, 1, \ldots, (2^m-1)]$, are selected first, wherein m is a positive integer, such as 8. In step 102, n-bit corrected gray levels $[y(1), \ldots, y(2^m)]$ corresponding to the original gray levels $[x(1), \ldots, x(2^m)]$ are calculated according to a gamma curve, wherein n is a positive integer, such as 10. The corrected gray levels $[y(1), \ldots, y(2^m)]$ are gamma values mapped from the original gray levels $[x(1), \ldots, x(2^m)]$ according to the gamma curve, and the corrected gray level y(i) is equal to $((x(i)/(2^m-1))^y \times (2^n-1))$ $(i=1\sim 2^m)$, wherein y is a gamma coefficient.

Following that, in step 104, differences of two adjacent corrected gray levels (y(i+1)−y(i)) are successively calculated. According to finite accumulated test results of the system circuit board and without consideration of minus values, when m=8, n=10 and y=2.2, the differences (y(i+1)−y(i)) are smaller than 32. That is, only 5 bits of memory space can store all the differences (y(i+1)−y(i)). If the minus values are considered, one more bit of memory is needed to record the minus symbol of values.

Finally, in step 106, the differences (y(i+1)−y(i)) are recorded as gamma reference values z(i+1) $(i=1\sim(2^m-1))$ corresponding to the original gray levels x(i+1) in the gamma table, in which the value z(1) corresponding to x(1) is y(1). Therefore, the gamma table records only the gamma reference values z(i+1) $(i=1\sim(2^m-1))$. Once any corrected gray level y(i) is given, the desired targeted corrected gray levels can be obtained by recursion, wherein y(1)=z(1), and y(i+1)=y(i)+z(i+1) $(i=1\sim(2^m-1))$. Owing that the gamma reference values z(i+1) $(i=1\sim(2^m-1))$ occupy only 5 bits of memory and there are totally 256 original gray levels, the total required memory is 256×5=1280 bits. As compared to the prior-art display requiring 2560 bits of memory, the display of the invention can save 50% of memory.

Embodiment Two

Figure 2:
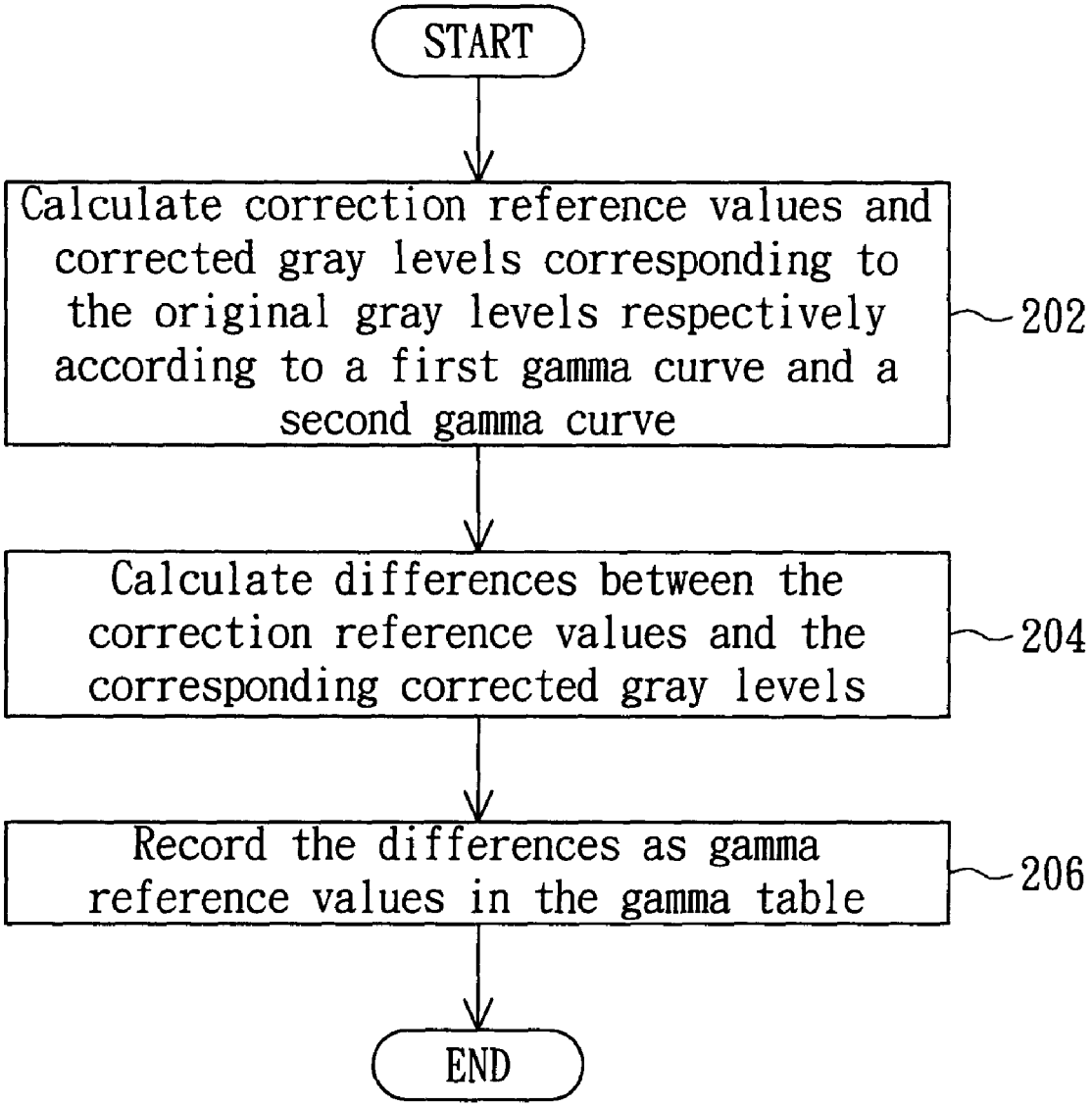
FIG. 2 is a flow chart of a method for generating a gamma table according to a second embodiment of the invention.

Referring to FIG. 2, a flow chart of a method for generating a gamma table according to a second embodiment of the invention is shown. The method for generating a gamma table is applied to a display. A number of m-bit original gray levels $[x(1), \ldots, x(2^m)]$, such as $[0, 1, \ldots, (2^m-1)]$, are selected first, wherein m is a positive integer, such as 8. In step 202, n-bit correction reference values $[y_1(1), \ldots, y_1(2^m)]$ corresponding to the original gray levels $[x(1), \ldots, x(2^m)]$ are calculated according to a first gamma curve, wherein n is a positive integer, such as 10. In the meanwhile, n-bit corrected gray levels $[y_2(1), \ldots, y_2(2^m)]$ corresponding to the original gray levels $[x(1), \ldots, x(2^m)]$ are calculated according to a second gamma curve. The correction reference values $[y_1(1), \ldots, y_1(2^m)]$ are gamma values mapped from the original gray levels $[x(1), \ldots, x(2^m)]$ according to the first gamma curve. The corrected gray levels $[y_2(1), \ldots, y_2(2^m)]$ are gamma values mapped from the original gray levels $[x(1), \ldots, x(2^m)]$ according to the second gamma curve. The correction reference value $y_1(i)$ is equal to $((x(i)/(2^m-1))^{y1} \times (2^n-1))$ $(i=1\sim 2^m)$, and the corrected gray level $y_2(i)$ is equal to $((x(i)/(2^m-1))^{y2} \times (2^n-1))$ $(i=1\sim 2^m)$, wherein y1 and y2 are different gamma coefficients. In the embodiment, the value y1 is set to be 1.

Following that, in step 204, differences $\{(y_1(i)-y_2(i)), i=1\sim(2^m-1)\}$ or $\{(y_2(i)-y_1(i)), i=1\sim(2^m-1)\}$ of the correction reference values $[y_1(1), \ldots, y_1(2^m)]$ and the corresponding corrected gray levels $[y_2(1), \ldots, y_2(2^m)]$ are calculated. When m=8, n=10, y1=1 and y2=2.2, after calculation, the difference $\{(y_1(i)=y_2(i)), i=1\sim(2^m-1)\}$ or $\{(y_2(i)-y_1(i)), i=1\sim(2^m-1)\}$ is about 289, which is located between 256 and 512. It represents that only 9 bits of memory is required to store the differences $\{(y_1(i)-y_2(i)), i=1\sim(2^m-1)\}$ or $\{(y_2(i)-y_1(i)), i=1\sim(2^m-1)\}$.

Finally, in step 206, the differences $\{(y_1(i)-y_2(i)), i=1\sim(2^m-1)\}$ or $\{(y_2(i)-y_1(i)), i=1\sim(2^m'1)\}$ are recorded as gamma reference values z(i)$(i=1\sim(2^m-1))$ corresponding to the original gray levels x(i) in the gamma table. Therefore, the gamma table records only the gamma reference values z(i) $(i=1\sim(2^m-1))$. Once the original gray levels $[x(1), \ldots, x(2^m)]$ are given, the correction reference values $[y_1(1), \ldots, y_1(2^m)]$ corresponding to the value y1=1 can be obtained. Then the corrected gray levels $[y_2(1), \ldots, y_2(2^m)]$ can be restored by recursion according to the gamma reference values z(i) $(i=1\sim(2^m-1))$, wherein $y_2(i)=(y_1(i)-z(i))$ or $(y_1(i)+z(i))$ $(i=1\sim 2^m)$. Owing that the gamma reference values z(i) $(i=1\sim(2^m-1))$ occupy only 9 bits of memory and there are totally 256 original gray levels, the total required memory is 256×9=2304 bits. As compared to the prior-art display requiring 2560 bits of memory, the display of the invention can save 10% of memory.

Embodiment Three

Figure 3:
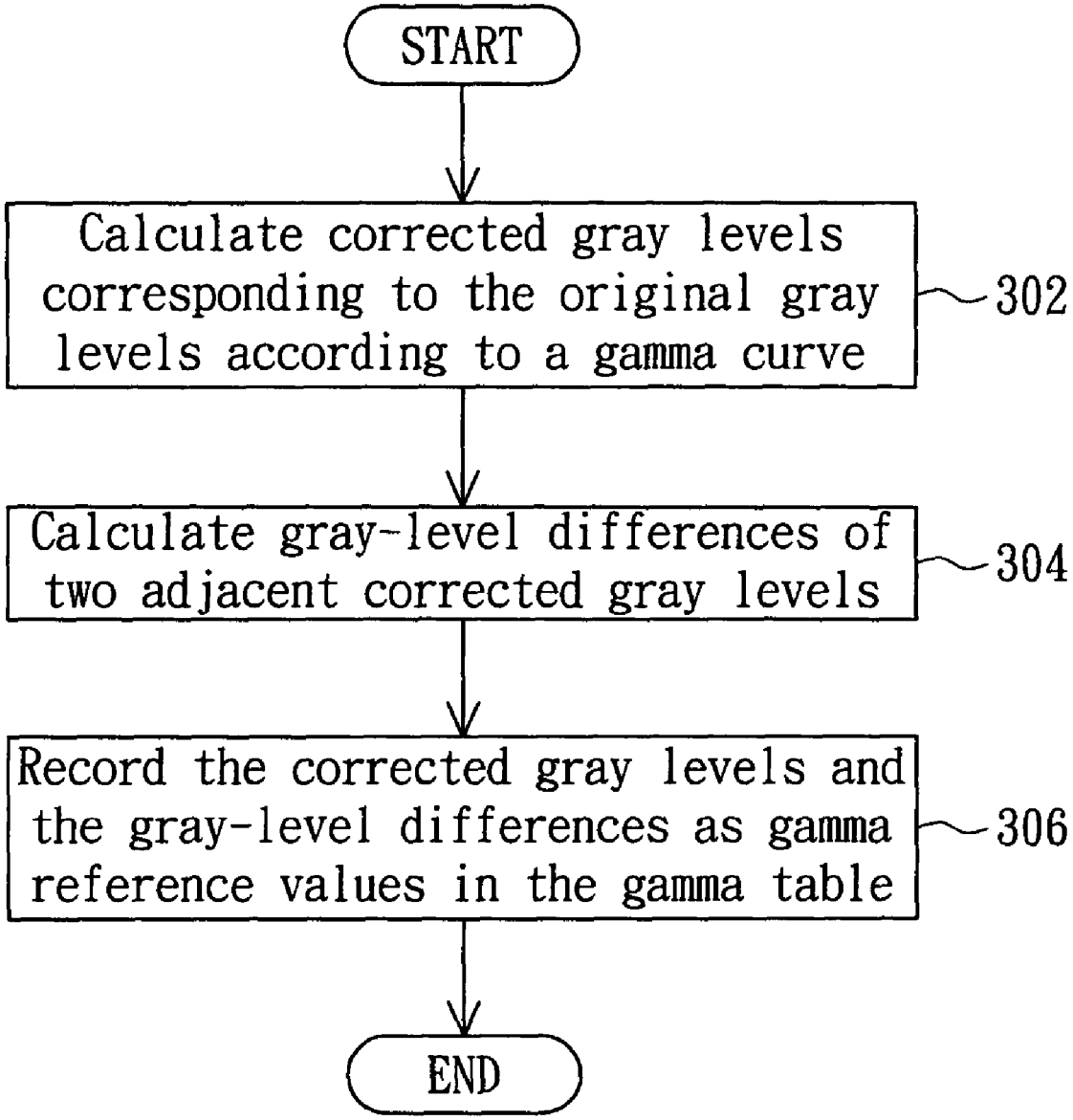
FIG. 3 is a flow chart of a method for generating a gamma table according to a third embodiment of the invention.

Referring to FIG. 3, a flow chart of a method for generating a gamma table according to a third embodiment of the invention is shown. The method for generating a gamma table is applied to a display. A number of m-bit original gray levels $[x(1), \ldots, x(2^m)]$, such as $[0, 1, \ldots, (2^m-1)]$, are selected first, wherein m is a positive integer, such as 8. In step 302, n-bit corrected gray levels $[y(1), \ldots, y(2^m)]$ corresponding to the original gray levels $[x(1), \ldots, x(2^m)]$ are calculated according to a gamma curve, wherein n is a positive integer, such as 10. The corrected gray levels $[y(1), \ldots, y(2^m)]$ are gamma values mapped from the original gray levels $[x(1), \ldots, x(2^m)]$ according to the gamma curve, and the corrected gray level y(i) is equal to $((x(i)/(2^m-1))^y x(2^n-1))$ $(i=1\sim 2^m)$, wherein y is a gamma coefficient.

Following that, in step 304, gray-level differences $w(i)=\{(y(i+1)-y(i)), i=1, 3, \ldots\}$ or $\{(y(i)-y(i+1)), i=1, 3, \ldots\}$ of two adjacent corrected gray levels y(i) and y(i+1) (i=1, 3, . . . ) are calculated. According to finite accumulated test results of the system circuit board and without consideration of minus values, when m=8, n=10 and y=2.2, the gray-level differences $w(i)=\{(y(i+1)-y(i)), i=1, 3, \ldots\}$ or $\{(y(i)-y(i+1)), i=1, 3, \ldots\}$ are smaller than 32. That is, only 5 bits of memory space can store the differences $w(i)=\{(y(i+1)-y(i)), i=1, 3, \ldots\}$ or $\{(y(i)-y(i+1)), i=1, 3, \ldots\}$. If the minus values are considered, one more bit of memory is needed to record the minus symbol of values.

Finally, in step 306, the n-bit corrected gray levels y(i) and the k-bit gray-level differences w(i) (i=1, 3, . . . ) are respectively recorded as (n+k)-bit gamma reference values z(i) (i=1, 3, . . . ) corresponding to the odd-order gray levels x(i) (i=1, 3, . . . ) in the gamma table, wherein k is a positive integer. Therefore, the gamma table records only the (n+k)-bit gamma reference values z(i) (i=1, 3, . . . ). Once the original gray levels $[x(1), \ldots, x(2^m)]$ are given, if the original gray level has an odd order, the corresponding corrected gray levels y(i) can be obtained from the gamma table. If the original gray level has an even order, the odd-order corrected gray levels y(i) and the gray-level differences w(i) (i=1, 3, . . . ) can be obtained by using the adjacent odd-order original gray levels and the desired even-order corrected gray levels y(i) can be obtained accordingly. Owing that the gamma reference values z(i) occupy only 15 bits of memory and there are totally 128 odd-order original gray levels to be recorded, the total required memory is 128×15=1920 bits. As compared to the prior-art display requiring 2560 bits of memory, the display of the invention can save 25% of memory.

The method for generating a gamma table disclosed by the above embodiments of the invention can simplify the gamma table content by recording the differences of the gray levels, thereby achieving the purpose of saving memory space and greatly reducing production cost.

While the invention has been described by way of example and in terms of three preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for generating a gamma table, applied to a display, the display obtaining n-bit corrected gray levels $[y(1), \ldots, y(2^m)]$ from m-bit original gray levels $[x(1), \ldots, x(2^m)]$ by using the gamma table, m and n being positive integers, the method comprising:

(a) calculating the corrected gray levels $[y(1), \ldots, y(2^m)]$ corresponding to the original gray levels $[x(1), \ldots, x(2^m)]$ according to a gamma curve; and (b) successively calculating differences of two adjacent corrected gray levels $(y(i+1)-y(i))$ and recording the differences as a plurality of gamma reference values $z(i+1)$ $(i=1\sim(2m-1))$ corresponding to the original gray levels $x(i+1)$, in which the value $z(1)$ corresponding to $x(1)$ is $y(1)$, in order to generate the gamma table.

2. The method according to claim 1, wherein the original gray levels $[x(1), \ldots, x(2^m)]$ are $[0,1, \ldots, (2^m-1)]$ and the corrected gray level $y(i)$ is equal to $15\ ((x(i)/(2^m-1))^y x(2^n-1))(i=1\sim 2^m)$, wherein y is a gamma coefficient.

3. The method according to claim 2, wherein when m=8, n=10 and y=2.2, each of the gamma reference values has a bit number not larger than 5 and the display requires a memory space of 256×5=1280 bits.

4. The method according to claim 1, wherein the display obtains the gamma reference values $[z(1), \ldots, z(2^m)]$ according to the gamma table and then restores the corrected gray levels $[y(1), \ldots, y(2^m)]$ by recursion, wherein $y(1)=z(1)$ and $y(i+1)=y(i)+z(i+1)(i=1\sim(2^m-1))$.

* * * * *